United States Patent [19]

Weinberg

[11] 4,433,847

[45] Feb. 28, 1984

[54] CONDUIT SEALING SYSTEM

[75] Inventor: Roger A. Weinberg, Houston, Tex.

[73] Assignee: Baker Oil Tools, Inc., Orange, Calif.

[21] Appl. No.: 361,678

[22] Filed: Mar. 25, 1982

[51] Int. Cl.[3] ..... F16J 15/12

[52] U.S. Cl. ..... 277/125

[58] Field of Search ..... 277/123, 124, 125

[56] References Cited

U.S. PATENT DOCUMENTS

| | | | |
|---|---|---|---|
| 1,184,212 | 5/1916 | Revschline | 277/124 |
| 2,075,019 | 3/1937 | Buck et al. | 277/125 |
| 3,048,412 | 8/1962 | Baker | 277/124 |
| 4,192,519 | 11/1980 | Buggele | 277/124 |
| 4,258,792 | 0/0000 | Restarick | 166/315 |

FOREIGN PATENT DOCUMENTS

| | | | |
|---|---|---|---|
| 559679 | 11/1927 | Fed. Rep. of Germany | 277/124 |
| 103761 | 2/1917 | United Kingdom | 277/124 |

*Primary Examiner*—Robert I. Smith

*Attorney, Agent, or Firm*—Norvell & Associates

[57] ABSTRACT

The invention relates to an annular seal system designed for high pressure applications in subterranean wells. The annular seal system comprises a vertical stack of subassemblies. Each subassembly incorporates an annular sealing element formed from an elastomeric material, such as a perfluoroelastomer, which is provided with a truncated pear-shaped cross-sectional configuration having reversely curved axial side surfaces. The sealing element is abutted on each axial side by a uniform thickness annular bearing element formed from a thermoplastic such as a polyphenylene sulfide resin having good bearing properties. Each of the thermoplastic bearing elements is in turn abutted by an annular metallic restraining element having correspondingly shaped reversely curved axial side surfaces and defining an inverted truncated pear-shaped cross-sectional configuration.

12 Claims, 4 Drawing Figures

CONDUIT SEALING SYSTEM

BACKGROUND OF THE INVENTION

1. Field of the Invention

This invention relates to an improved seal system designed for particular use in completion and production operations of oil and gas wells wherein the seal system greatly reduces the tendency and incidence of seal extrusion, seizure or sticking.

2. Description of the Prior Art

Movement of tubing within the sealng bores of packers, bridge plugs, and the like, during completion and production operations in high pressure, high temperature oil and gas wells has been a major cause of damage to seal systems and subsequent diminished performance and sealing integrity of such seal systems. Damage to the seal systems has become a greater problem during the present intensive search for new oil and gas reserves, wherein the drilling and subsequent completion is in deeper wells, involving exposure to extremely hostile high temperature, high pressure environments and wherein the well production may contain a significant amount of hydrogen sulfide, carbon dioxide and methane.

To overcome these conditions and thus successfully complete such a well, the seal system must have continuous sealing integrity. The seal system must be resistant not only to the damaging effects of the well environment (i.e., temperature, pressure, fluids) but also to the physical stresses imposed by or resulting from completion or workover techniques, i.e., unrestrained tubing movement, build up of corrosive products in the sealing annular area, and the like.

Typical prior art seals for use between nested subterranean tubular conduits are seals such as O-ring seals and T-seals, which respectively have circular and T-shaped cross sections. Seal stacks having chevron shaped cross-sections are also quite common. U.S. Pat. No. 3,799,204 discloses a subterranean safety valve using O-ring seals, T-seals and chevron seals. Seals having a triangular or delta shaped cross section have also been used between concentric tubular members. Back-up or bearing elements to prevent extrusion of elastomeric sealing elements have been used with T-seals, with chevron seals and with delta seals.

U.S. Pat. No. 2,862,563, illustrates a well packer assembly for packing the annular space between tubing in a well, wherein resilient annular packing elements are spaced about a tubular mandrel to form a seal in the annulus. U.S. Pat. No. 3,083,775 teaches the use of a formation packer wherein a plurality of resilient annular packing elements are spaced about a tubular mandrel and a plurality of folded metal plates which are set on a double traveling mandrel. U.S. Pat. No. 3,531,236 discloses a tubular sealing assembly having chevron sealing rings formed from a fluoroelastomer and asbestos, with fluorocarbon plastic ring adaptors at each end of the seal stack. U.S. Pat. No. 2,467,822 teaches the use of a rubber or similar packing material which is prevented from flowing through the opening between the packer body and the packing retainer or abutment surrounding the body.

The prior art also shows a number of generic seal systems which may have utility in the sealing of an annular well conduit. For example, U.S. Pat. No. 3,467,394 shows a packing means of a V-ring type wherein the packing arrangement comprises a polytetrafluoroethylene, commonly marketed under the trademark "TEFLON", with relatively rigid V-ring shaped spacer rings interposed between a plurality of the elastomer V-rings. Additionally, U.S. Pat. No. 4,050,701 shows ring seals obtained from a mixture of polyphenylene sulfide and polytetrafluoroethylene, for use in the fluid sealing of rotary and/or reciprocating shafts. Similarly, U.S. Pat. No. 3,626,337 discloses a packing ring for use in high temperature and pressure environments wherein a thermoplastic type composition, such as rubberized nylon, tetrafluoroethylene, polyesters, acrylics and the like, are laminated to form the final seal substance. Lastly, U.S. Pat. No. 3,799,454, discloses a coating composition containing polytetrafluoroethylene and polyphenylene sulfide for formation of a seal system.

Generally, the seal systems of the prior art have not been totally suitable for use in wells having high temperature and pressures and corrosive fluids, and have also been found to be deficient when exposed to even less severe environments.

To overcome these deficiencies it has been suggested that various new elastomeric type materials be used in the sealing systems. A report of the 52nd Annual Fall Technical Conference and Exhibition of the Society of Pertroleum Engineers, Oct. 9 through 12, 1977 discusses the testing of a number of the various new elastomeric type materials in relation to their use in packer seal systems. This Report No. SPE 6762 discloses the use of three particular elastomeric type materials which can be utilized in packer seal systems. These elastomeric materials are commonly sold under the trademarks of "TEFLON", a polymer of tetrafluoroethylene, "RYTON", a polymer of polyphenylene sulfide, and "KALREZ", a perfluoroelastomer.

Polytetrafluoroethylene, sold under the DuPont trademark "TEFLON", is a flexible fluoropolymer having a high degree of permanent set and cold flow. It also has a high resistance to corrosive chemicals and high temperatures. It can be used as virgin material or it may be filled with a suitable filler, i.e. glass particles.

Polyphenylene sulfide resin, sold under the trademark "RYTON" by Phillips Petroleum Company, is a thermoplastic resin characterized by a high thermal stability, good bearing properties excellent chemical resistance, and a high affinity for fillers. The resin may be the reaction product of p-dichlorobenzene and sodium sulfide in a polar solvent, as disclosed in U.S. Pat. No. 3,354,129.

The perfluoroelastomer, sold under the trademark "KALREZ" by DuPont, is a material characterized by high thermal stability and excellent chemical resistance. Exemplary of such perfluoroelastomers is the reaction product of perfluoro (3-phenoxpropylvinyl ether) and at least one fluorine-containing ethylenically unsaturated monomer, as fully disclosed in U.S. Pat. No. 3,682,872.

The above described elastomeric materials have been used in packer seal systems, but not with complete success. It has been found that seal systems which incorporate these elastomeric materials have a strong tendency to extrude and to adhere or stick to the conduit when the seal system must be retrieved from the well.

A commercially successful seal assembly made from "TEFLON", "RYTON" and "KALREZ" components is disclosed in U.S. Pat. No. 4,234,197. Although, the results achieved by the seal configurations disclosed in this patent were far better than prior art seals, the seals were still subject to failure due to extrusion when pressure differentials in excess of 20,000 psi were required to be sealed. In many wells being currently drilled, and produced today, pressures in excess of 20,000 psi can be encountered. There is, therefore, a need for a sealing arrangement between two nested conduits which will successfully withstand pressure differentials in excess of 20,000 psi without incurring severe extrusion of the sealing material or failure of the seal due to sticking of the sealing material whenever relative movement occurs between the two conduits.

SUMMARY OF THE INVENTION

This invention provides a stack of annular sealing elements which can withstand pressure differentials in excess of 20,000 psi. The annular stack comprises, in addition to metallic or nonextrudible end members respectively disposed at each end of the stack, a plurality of annular elements formed in a specific configuration from the elastomeric material sold under the trademark "KALREZ" and restrained on both sides by annular elements formed from the organic material sold under the trademark "RYTON". The "KALREZ" element functions as the primary sealing element and is provided with a truncated pear-shaped cross-sectional configuration. In particular, the outer peripheral face of each "KALREZ" sealing element is of substantially less axial dimension than the inner peripheral face. Moreover, each of the opposed side walls of the truncated pear-shaped cross-sectional configuration is formed with a reversely curved shape.

Each of the truncated pear-shaped elements formed from "KALREZ" is abutted on each axial side by a correspondingly shaped uniform width, annular layer of "RYTON" material which is a good bearing material and relatively nonextrudible. The "RYTON" bearing elements are abutted on their other axial sides by an annular restraining element formed from metal or other relatively non-extrudible material, which has an inverted truncated pear-shaped cross-section to conform to the axially adjacent "RYTON" elements. At the end of the stack, the nonextrudible end members become the force transmitting rings by which a substantial axial loading force is imposed on the assemblage.

With the described arrangement, each "KALREZ" sealing element is retained in assemblage and effectively prevented from extruding by the reversely sloped adjacent surfaces of the "RYTON" annular elements, which, due to the truncated pear-shaped configuration of the "KALREZ" annular elements, positively retain the "KALREZ" elements in the assemblage. Similarly, the "RYTON" elements are effectively restrained from radial displacement by the adjacent reversely sloped surfaces of the metal restraining elements.

Further objects and advantages of the invention will be readily apparent to those skilled in the art from the following description, taken in conjunction with the annexed sheet of drawing upon which is shown a preferred embodiment of the invention.

DESCRIPTION OF THE PREFERRED EMBODIMENT

Figure 1:
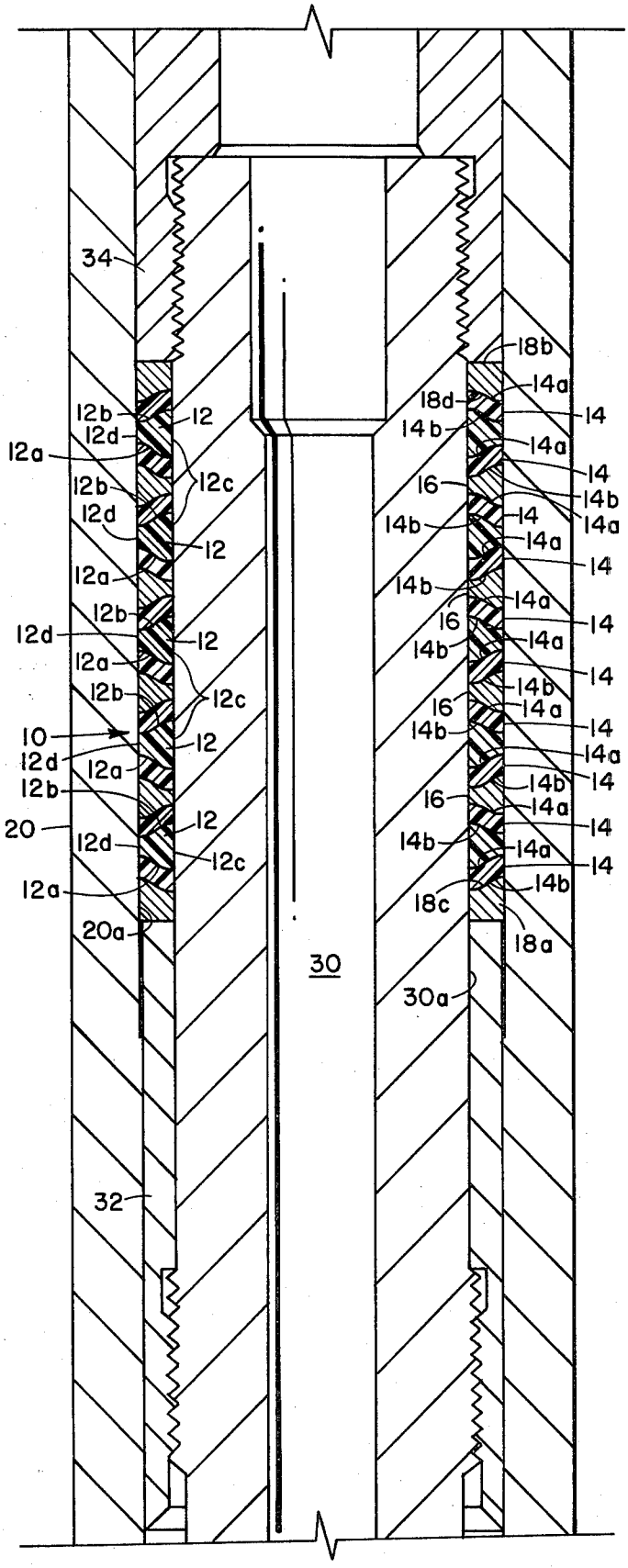
FIG. 1 is a schematic vertical sectional view of an annular seal assembly embodying this invention shown in assembled relationship between two annular conduits.
Figure 4:
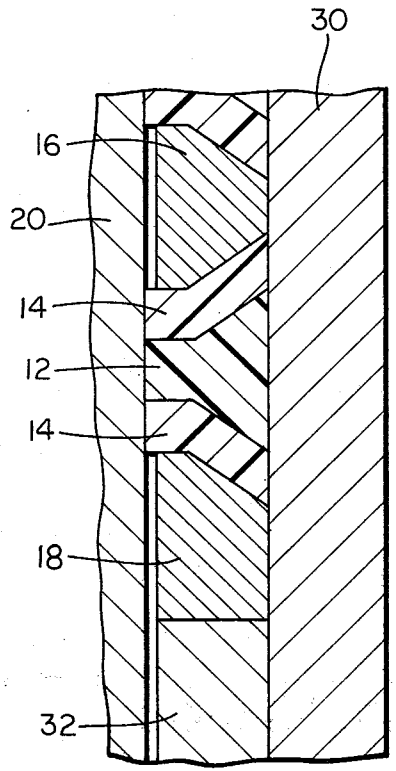
FIG. 4 is a schematic similar to FIG. 3, but at an elevated temperature.

Referring to FIG. 1, an annular stack 10 of sealing elements constructed in accordance with this invention is shown in operative relationship between an interior cylindrical seal bore surface 20*a* of a first conduit or tubular member 20 and the external cylindrical surface 30*a* of a second conduit or tubular member 30. Seal element 10 thus effects the sealing of the annular fluid passage defined between the two conduits 20 and 30. Conduits 20 and 30 may be employed in any downhole apparatus in a subterranean well, hence are normally exposed to hostile environmental conditions such as excessively high temperatures, pressures and significant amounts of corrosive fluids. For example, conduit 30 could comprise the outer housing of a wireline retrievable safety valve.

Seal assembly 10 comprises a vertical stack of a plurality of identical subassemblies. Each subassembly includes an annular seal element 12 which in the preferred embodiment is formed from an organic material such as a perfluoroelastomer sold under the trademark "KALREZ" by DuPont which is a material characterized by high thermal stability, and excellent sealing properties and chemical resistance. This seal configuration could, however, employ other elastomers or polymeric materials having suitable physical characteristics. Each "KALREZ" sealing element 12 is formed with truncated pear-shaped cross-sectional configuration so that the opposed sides 12*a* and 12*b* respectively have reversely curved or angled configurations. The inner periphery 12*c* defining a base section of sealing element 12 is substantially wider than the outer periphery defining a tip section 12*d*. The tip section adjacent the outer periphery also has generally parallel sides. The base section has sloping sides.

Adjacent each of the side walls 12*a* and 12*b* there is provided an annular bearing or back-up element 14 formed from a thermoplastic material such as polyphenylene sulfide resin sold under the trademark "RYTON" by Phillips Petroleum Company and characterized by a high thermal stability, good bearing properties and excellent chemical resistance. Appropriate fillers, such as glass particles may be employed in the "RYTON" material. Moreover, the "RYTON", with or without fillers, is substantially nonextrudible. Other materials could be used to form the bearing element, but the material employed in bearing or back-up element 14 should have a greater resistance to extrusion than the material employed in the sealing element 12. Each "RYTON" annular element 14 is of uniform axial thickness and thus defines parallel side surfaces 14*a* and 14*b*, one of which is in engagement with the correspondingly shaped reversely curved surfaces of the adjacent "KALREZ" sealing element 12. The tip section at the outer periphery of the annular ring bearing or back-up element 14 has parallel sides which are substantially normal to the axis of the conduit. Although the thickness of each back-up element 14 remains substantially constant the base section has parallel surfaces inclined relative to the axis of the conduit. Note that the tip section adjacent the outer periphery 12*d* of the seal element has parallel sides and extends between back-up elements 14 to maintain a continuous sealing with the opposite conduit.

To restrain both the seal elements 12 and the back-up elements 14, each subassembly includes an annular retaining or restraining element 16 formed of metal or a rigid nonextrudible plastic material. Each element 16 has an inverted truncated pear-shaped configuration so as to provide reversely curved axial side surfaces which respectively correspond to and snugly engage the side surfaces 14*a* or 14*b* of the adjacent "RYTON" bearing element 14.

End cap members 18*a* and 18*b* are respectively provided at the bottom and top ends of the stack of seal subassemblies adjacent the ends of a seal receptacle in which the seal subassemblies are mounted, and these elements respectively have only one axial face 18*c* and 18*d* reversely curved to correspond to the adjacent "RYTON" bearing element.

Figure 3:
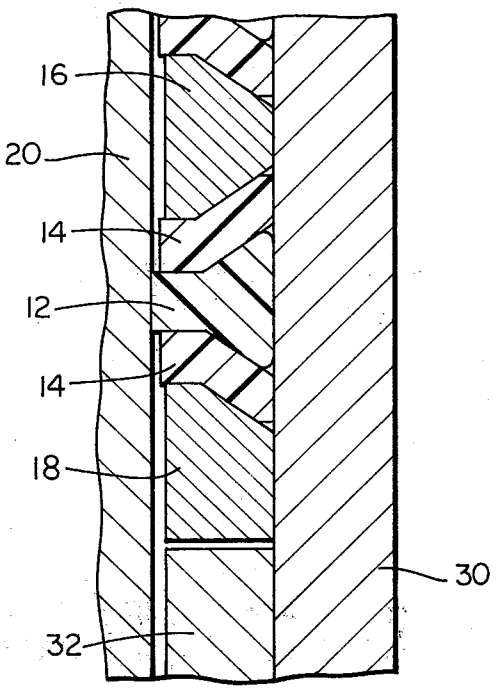
FIG. 3 is a schematic similar to FIG. 2 after insertion into an exterior conduit.
Figure 2:
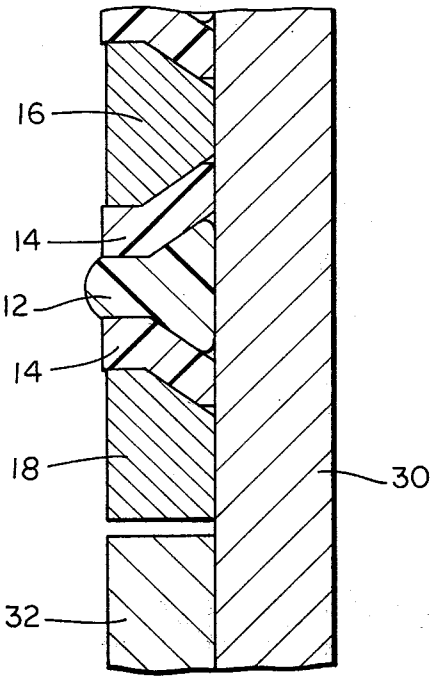
FIG. 2 is a schematic cross sectional view of a portion of a seal stack prior to insertion into the bore of an exterior conduit.

As shown in FIG. 1 the seal assembly can be affixed to the exterior of the inner conduit by clamping the seal assembly between two sleeve elements 32 and 34, both of which are threadably attached to the second conduit 30 and screwed onto the conduit 30. As can be seen in FIG. 2 showing the relaxed state of the seal assembly, the tip section of the primary sealing element extends radially beyond the exterior surface of back-up or bearing element 14 and metallic elements 16 and 18. When this seal assembly is inserted into the bore of the exterior conduit 20 only the radially exposed tip of the primary sealing element 12 contacts the seal bore of conduit 20. This condition is illustrated by FIG. 3 which shows the seal assembly at ambient temperature. At ambient temperature the tips of thermoplastic back-up ring elements 14 are spaced from the seal bore to provide sufficient gap for assembly of the tool. At this temperature the primary sealing element 12 has sufficient strength and stiffness to resist extrusion into this gap. As the temperature increases, the primary sealing element, comprising a material such as "KALREZ" begins to lose some of its strength and stiffness. The softened primary sealing element therefore has less resistance to extrusion. At elevated temperatures, the primary sealing element could extrude into the gaps shown in FIG. 2. However, as the temperature increases, thermal expansion causes the back-up elements 14 to expand and close the original assembly gap to prevent extrusion of the primary sealing element. The primary sealing element base portion adjacent the inner periphery 12*c* also exerts an outward force on back-up rings 14 as it expands. This force is transmitted through the sloped or tapered interface between back-up elements 14 and primary sealing elements 12.

Both the "KALREZ" sealing and the adjacent "RYTON" bearing elements are effectively prevented from being radially dislodged from the assembly, either by the axial clamping force or by a pressure differential encountered in service, because they are axially constrained by reversely curved surfaces which effectively neutralize any radial components of applied axial forces which would tend to displace either of the elements 12 or 14 in a radially outward direction. Moreover, each of the "KALREZ" annular sealing elements has axial forces applied thereto only by the adjoining "RYTON" bearing elements 14, and this eliminates the possibility of the force transmitting elements effecting a cutting or shearing action on the relatively softer "KALREZ" sealing element. Compressive axial loads will, however, cause the primary sealing element to expand radially to effect a seal. The parallel sides of the tip sections adjacent the outer periphery 12*d* prevent the back-up members from squeezing or pinching off the tip section resulting in a loss of contact between primary sealing element 12 and conduit 20.

The aforedescribed sealing arrangement will successfully withstand the hostile well environments and has successfully maintained a seal against pressure differentials greater than 20,000 psi. Moreover, whenever relative movement of the first conduit 20 relative to the second conduit 30 is required, such movement can be accommodated without resulting in significant sticking of any elements of the seal assembly to the relatively moving surfaces. Lastly, extrusion of the "KALREZ" sealing element is significantly reduced through the utilization of the specific seal configurations heretofore described.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. In a seal system mountable on a first conduit and sealingly engagable with a second conduit within a well bore for isolating an annular section between said conduits, the improvement comprising a plurality of axially spaced, annular, elastomeric sealing elements having a truncated pear-shaped cross-section with an inner peripheral surface of greater axial length than the outer peripheral surface and reversely curved side wall surfaces connecting said inner and outer peripheral surfaces, an annular bearing element formed of a relatively nonextrudable bearing material abutting each axial side of each said elastomeric sealing element with a correspondingly shaped reversely curved surface, and means for axially clamping all said sealing elements and retaining elements in assembly.

2. The seal system of claim 1 wherein each said annular sealing element is formed of an elastomer derived from the copolymerization of tetrafluoroethylene and perfluorethers.

3. The seal system of claim 1 or 2 wherein each said annular bearing element is formed from a polymer of polyphenylene sulfide.

4. In a seal system mountable on a first conduit and sealingly engagable with a second conduit within a well bore for isolating an annular section between said conduits, the improvement comprising a plurality of axially spaced, annular elastomeric sealing elements having a truncated pear-shaped cross-section with an inner peripheral surface of greater axial length than the outer peripheral surface and reversely curved side wall surfaces connecting said inner and outer peripheral surfaces, a first and second annular bearing elements formed of relatively non-extrudable bearing material respectively abutting each side of each said elastomeric sealing element with a correspondingly shaped reversely curved surface, said first and second bearing elements each having substantially uniform axial thickness, and an annular restraining element disposed between adjacent pairs of first and second annular bearing elements, said restraining element having an inverted truncated pear-shaped cross-sectional configuration to conform to the adjacent surfaces of said first and second annular bearing elements, said annular restraining element being formed from a nonextrudible material, and means for axially clamping all said annular sealing members, said first and second annular bearing elements, and said annular restraining element in assembly.

5. The seal system of claim 4 wherein each said annular elastomeric sealing element is formed from an elastomer derived from the copolymerization of tetrafluoroethylene and perfluorethers.

6. The seal system of claim 4 or 5 wherein each said first and second annular elastomeric bearing element is formed from a polymer of polyphenylene sulfide.

7. In a seal system comprising a seal stack mountable on a first tubular member and sealingly engagable with a second concentric tubular member within a well bore for isolating an annular section between said tubular members, the improvement comprising: a receptacle on said first tubular member in which said seal stack is mounted; a plurality of annular elastomeric sealing elements axially spaced in said receptacle, each sealing element having a base adjacent said first tubular member, and a tip section radially spaced from said base section, the width of said base section being greater than the width of said tip section; relatively more rigid retaining means between tip sections of adjacent sealing elements for holding said sealing elements in said receptacle; and back-up means for resisting axial extrusion of said sealing elements, and further comprising bearing elements bearing upon each side of the sealing elements having a substantially uniform thickness, and having a resistance to axial extrusion greater than said sealing elements, said bearing elements extending from said base section to said tip section on each side of each sealing element.

8. The seal system of claim 7 wherein said retaining means comprises an inverted member having the same cross-section as said sealing element.

9. The seal system of claim 8 wherein said back-up means comprises members extending between each sealing element and adjacent retaining means and having complementary mating surfaces contoured to contact the radially surfaces of said sealing elements and said retaining means from the base sections to the tip sections thereof.

10. The seal system of claim 7, 8 or 9 wherein said sealing elements have substantially parallel sides along the tip sections with said back-up means being spaced apart adjacent said tip sections.

11. In a seal system comprising a seal stack mountable on a first tubular member and sealingly engagable with a second concentric tubular member within a well bore for isolating an annular section between said tubular members, the improvement comprising a receptacle on said first tubular member in which said seal stack is mounted; a plurality of annular elastomeric sealing elements axially spaced in said receptacle each sealing element having a base portion adjacent said first tubular member and a tip section, said base section having inwardly sloped radially extending faces with said tip section having a constant thickness less than the thickness of said base section; relatively more rigid retaining means between tip sections of adjacent sealing elements for holding said sealing elements in said receptacle; and back-up means for resisting axial extrusion of said sealing elements, and further comprising bearing elements bearing upon each side of the sealing elements having a substantially uniform thickness, and having a resistance to axial extrusion greater than said sealing elements, said bearing elements extending from said base section to said tip section on each side of each sealing element.

12. In a seal system comprising a seal stack mountable on a first tubular member and sealingly engagable with a second concentric tubular member within a well bore for isolating an annular section between said tubular members, the improvement comprising: a receptacle on said first tubular member in which said seal stack is mounted; a plurality of annular elastomeric sealing elements axially spaced in said receptacle, each sealing element having a base adjacent said first tubular member, and a tip section radially spaced from said base section, the width of said base section being greater than the width of said tip section; and a plurality of relatively more rigid annular retaining elements, each located between adjacent elastomeric sealing elements, each retaining element comprising a member having an inverted cross-section corresponding to the cross-section of said sealing elements, the retaining elements comprising means for holding said sealing elements in said receptacle.

* * * * *